United States Patent [19]

Blumer

[11] Patent Number: 4,471,215

[45] Date of Patent: Sep. 11, 1984

[54] SELF-REGULATING HEATING CABLE HAVING RADIATION GRAFTED JACKET

[75] Inventor: Roger L. Blumer, Cortland, Ohio

[73] Assignee: Eaton Corporation, Cleveland, Ohio

[21] Appl. No.: 525,848

[22] Filed: Aug. 24, 1983

[51] Int. Cl.[3] ..... H05B 3/2

[52] U.S. Cl. ..... 219/553; 29/611; 204/159.17; 219/528; 219/549; 264/105; 338/22 R; 252/511

[58] Field of Search ..... 219/528, 544, 548, 549, 219/553; 338/22 R, 22 SD, 212; 29/611; 264/105; 204/159.17; 252/511

[56] References Cited

U.S. PATENT DOCUMENTS

| | | | |
|---|---|---|---|
| 3,858,144 | 12/1974 | Bedard et al. | 338/22 R |
| 3,861,029 | 1/1975 | Smith-Johannsen et al. | 29/611 |
| 3,914,363 | 10/1975 | Bedard et al. | 264/105 |
| 4,188,276 | 2/1980 | Lyons et al. | 204/159.17 |
| 4,277,673 | 7/1981 | Kelly | 219/528 |
| 4,286,376 | 9/1981 | Smith-Johannsen et al. | 29/611 |
| 4,309,596 | 1/1982 | Crowley | 219/549 |
| 4,327,480 | 5/1982 | Kelly | 29/611 |
| 4,334,148 | 6/1982 | Kampe | 219/553 |
| 4,334,351 | 6/1982 | Sopory | 29/611 |

*Primary Examiner*—Volodymyr Y. Mayewsky
*Attorney, Agent, or Firm*—C. H. Grace; A. E. Chrow

[57] ABSTRACT

Disclosed is a method of radiation grafting a shape retaining jacket (32) made from an elastomeric polyurethane to an olefinic semi-conductive composition electrically interconnecting at least two elongate spaced-apart conductors (28) to provide an improved, flexible, elongate semi-conductive heating cable (8) that is provided with improved mechanical and electrical integrity and diminished imperfections and improved handling characteristics by reason of a substantially improved bond between the jacket and the olefinic semi-conductive composition arising from radiation grafting in a process that includes a means (14) of oxidizing the outer surface of the semi-conductive surface in combination with application of vacuum able to draw the jacket against the semi-conductive composition within not more than about one and one-half inches from the exit of a die head (4) through which the product is passed.

12 Claims, 5 Drawing Figures

SELF-REGULATING HEATING CABLE HAVING RADIATION GRAFTED JACKET

INTRODUCTION

This invention relates generally to an elongate, flexible, electrically semi-conductive, self-regulating heating cable of the type having at least one pair of spaced-apart electrical conductors electrically interconnected by a semi-conductive composition that is enclosed by at least one shape retaining electrically insulative jacket and more particularly to such cable wherein the semi-conductive composition is predominately olefinic in nature and the shape retaining jacket is made from a polyurethane elastomer that is bonded thereto by means of radiation grafting during the process of making the cable to provide the cable with improved mechanical integrity while eliminating imperfections heretofore associated with such jackets as well as ensuring the electrical integrity of the cable by preventing moisture from traveling along the cable between the jacket and the olefinic semi-conductive composition.

BACKGROUND OF THE INVENTION

Self-regulating, electrically semi-conductive, heating cables are well known in the art. They generally feature at least one pair of elongate electrical conductors such as stranded or solid copper wires that are spaced apart from each coextensively along the length of the cable and are embedded within and electrically interconnected by means of a semi-conductive composition that typically comprises one or more polymeric materials such as a polyolefin or fluorocarbon or chlorofluorocarbon materials containing an amount of uniformly dispersed electrically conductive particles sufficient to impart the degree of semi-conductivity for the current regulating characteristics desired. Examples of self-regulating cables of the type described above are disclosed for example in U.S. Pat. Nos. 3,858,144; 4,188,276; 4,200,973; 4,277,673; 4,327,480; 4,334,351; and 4,334,148, the disclosures of which are incorporated herein by reference.

Typically, the semi-conductive composition is a composition that exhibits a positive temperature coefficient (PTC) characterized by exhibiting increasing electrical resistance with increasing temperatures up to a temperature at which the resistance is high enough to prevent current flow for the particular voltage applied across the spaced apart conductors. In making such cables, it is common practice to enclose the semi-conductive composition with a shape-retaining jacket that has a melt point temperature higher than that of the semi-conductive composition and then anneal the combination at a temperature at or above the melt point of the semi-conductive composition and below the melt point of the jacket material for a period of time necessary to reduce the volume resistivity of the semi-conductive composition to the level desired while preventing shifting of the conductors and then cross-link the combination by suitable means such as by exposing the combination to high energy electron radiation. Such cables often include one or more additional polymeric and/or metallic jackets about the shape-retaining jacket for added mechanical protection and the like.

The semi-conductive polymeric compositions used in the present invention are generally olefinic polymers and copolymers such as low, medium and high density polyethylene and blends thereof and polypropylene polymers and copolymers and blends thereof having at least about 20% crystallinity as determined by x-ray diffraction as is well known in the art. Commonly used for lower operating temperature self-regulating heating cables are copolymers of ethylene (e.g. polyethylene) and vinyl acetate or ethylene-ethyl acetate copolymers. Understandably, the semi-conductive composition may exhibit one or more crystalline melting temperatures depending on the nature of the particular combination of polymers and copolymers used. For example, a blend of a low density polyethylene and ethylene-vinyl acetate having an acetate content of about 18%, typically exhibits two crystalline melting points that are about 20°–22° C. apart. The term "olefinic semi-conductive composition" as hereinafter used means a composition that is primarily olefinic in nature by containing a predominate amount of one or more olefinic polymers or copolymers or blends thereof hereinbefore described exhibiting one or more crystalline melt point temperatures that contain an amount of one or more types of electrically conductive particles, preferably carbon black particles, that can be formed, preferably by melt extrusion, about the electrical conductors and possesses sufficient crystallinity to provide the self-regulating characteristics desired.

The olefinic semi-conductive composition used in the present invention may also include effective amounts of additional ingredients such as anti-oxidants, heat stabilizers, processing aids and the like provided they do not interfere with the processing and self regulating characteristics desired.

Depending upon the degree of semi-conductivity desired, typically from about 5% to about 25% and more commonly from about 10% to about 25% and even more preferably from about 17% to about 22% by weight of one or more electrically conductive particles to the total weight of the composition are uniformly blended with the olefinic polymer or copolymer to provide the olefinic semi-conductive composition which is then formed, preferably by melt extrusion, about the spaced-apart electrical conductors as hereinbefore described. Preferably, the conductive particles comprise one or more types of electrically conductive carbon black particles of which one particularly suitable type of carbon black is sold under the tradename VULCAN XC-72 by Cabot Corporation.

The shape-retaining jacket used in the invention is made from a thermoplastic polyurethane elastomer that is able to be formed, preferably by melt-extrusion, about the olefinic semi-conductive composition. The use of thermoplastic polyurethane elastomers for the shape retaining jacket is well known such as, for example, the use of a polyurethane elastomer sold under the tradename TEXIN 591-A by Mobay Corporation and by Goodrich Chemical Company under the tradename ESTANE 58305 disclosed in U.S. Pat. No. 3,914,363, the disclosure of which is incorporated herein by reference.

Historically, it has been difficult to bond polyurethane elastomers to polyolefinic materials. Heretofor polyurethane elastomers commonly have been formed about olefinic semi-conductive compositions by melt extruding a tube of the elastomer about the semi-conductive composition and then drawing the tube snugly about the composition by applying a vacuum within the tube as disclosed, for example, in U.S. Pat. No. 4,286,376. It has been discovered, however, that under such conditions and without more the polyurethane elastomer exhibits little or no melt fusion bond to the olefinic semi-conductive composition and is subject to imperfections such as sink marks and bubbles and the like as well as having reduced mechanical integrity such as in the form of wrinkling in the region of bending and is subject to underdesirable changes in conductivity due to exposure to moisture that is able to penetrate the semi-conductive composition by migrating along the cable between the semi-conductive composition and the jacket. It is also well known as, for example, disclosed in U.S. Pat. No. 4,334,351, the disclosure of which is incorporated herein by reference, that the handling characteristics of a laminate structure is greatly improved when a substantial bond exists between the layers of the laminate enabling it to act as a unitary structure.

In view of the above, a need exists to provide a means by which to improve the mechanical and electrical integrity of a self-regulating heating cable of the type utilizing an olefinic semi-conductive composition enclosed by a polyurethane elastomer shape-retaining jacket as well as eliminate imperfections heretofore associated with such jackets in the past in addition to improving the overall handling characteristics of the cable.

SUMMARY OF THE INVENTION

Accordingly, it is an object of this invention to provide an improved, flexible, self-regulating heating cable of the type utilizing an olefinic semi-conductive composition enclosed by a polyurethane elastomeric shape-retaining jacket having improved mechanical and electrical integrity in addition to eliminating imperfections and undesirable handling characteristics heretofore associated with such cables in the past.

It is another object of this invention to provide an improved, flexible, self-regulating heating cable of the type featuring an olefinic semi-conductive composition encompassed by a polyurethane elastomeric shape-retaining jacket having improved handling characteristics as well as improved mechanical integrity in addition to improved resistance to moisture migration along the cable between the semi-conductive composition and the jacket as a result of the establishment of an intimate bond therebetween.

It is yet a further object of this invention to provide a method of providing a bond between an elastomeric polyurethane shape-retaining jacket disposed about an olefinic semi-conductive composition of a flexible, self-regulating heating cable sufficient to impart the cable with improved mechanical and electrical integrity as well as improved handling characteristics along with elimination of imperfections heretofore associated with such jackets in the past.

BRIEF DESCRIPTION OF THE DRAWINGS

FIG. 1 shows a schematic plan-view of an embodiment of one method by which the self-regulating heating cable of the invention can be made;

DESCRIPTION OF A PREFERRED EMBODIMENT

Figure 7:
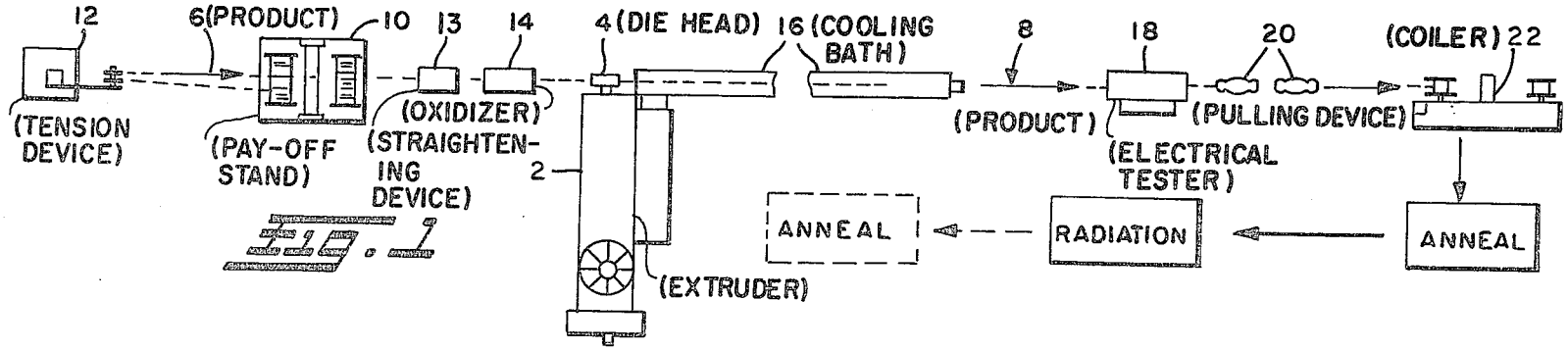

As previously described, the methods by which others have formed a shape retaining jacket about an olefinic semi-conductive composition of a self-regulating heating cable has not resulted in a melt fusion bond between the two substantial enough to improve the mechanical and electrical integrity and handling characteristics of the cable.

It has been discovered, however, that a bond between an olefinic semi-conductive composition and an encompassing elastomeric polyurethane shape retaining jacket sufficient to provide the cable with improved mechanical and electrical integrity as well as improved handling characteristics can be achieved by employing a method which includes the steps of:

(a) forming the olefinic semi-conductive composition about the spaced-apart conductors along the length of the cable to provide a semi-conductive electrical interconnection therebetween;

(b) oxidizing the outer surface of the semi-conductive composition;

(c) passing the product provided by step (b) through a die head having an entrance and an exit;

(d) rendering the elastomeric polyurethane into a melt flowable state;

(e) introducing the polyurethane of step (d) into the die head of step (c);

(f) forming the polyurethane of step (d) within the die head of step (c) into a shaped annular layer about the product of step (b) by means of a die supported therewithin;

(g) introducing a vacuum between the product of step (b) and the shaped annular polyurethane layer of step (f) sufficient to draw said layer snugly thereagainst within not more than about one and one-half inches from the die head exit;

(h) annealing the product of step (g) at a temperature and for a period of time sufficient to provide the semi-conductive composition with the ambient electrical resistance desired; and (i) exposing the product of step (g) to an amount of radiation sufficient to crosslink the semi-conductive composition to the degree desired and effect a radiation grafted bond of the elastomeric polyurethane layer thereto sufficient to enable said product to act as a unitary structure to improve the mechanical and electrical integrity thereof.

It is belived that the radiation grafted bond arises as a result of the extremely intimate contacting relationship between the jacket and the olefinic semi-conductive composition provided by the above described method. Although the method described herein is preferred, it is to be understood that any method which results in a contacting relationship intimate enough to enable the jacket and semi-conductive olefinic composition to be radiation grafted together is considered to be within the scope of the invention.

One method of making the self-regulating heating cable of the invention is illustrated in FIGS. 1-4 of which FIG. 1 shows a plan-view of a method by which the elastomeric polyurethane layer is formed about the semi-conductive composition which has already been formed about the spaced-apart electrical conductors by a prior process (not shown). The semi-conductive composition may be formed about the spaced-apart electrical conductors to provide an electrical interconnection therebetween along the length of the cable by any suitable means. Preferably, the semi-conductive composition is rendered into a melt-flowable state by a suitable extruder and extruded into a die head through which the spaced-apart conductors are passing which contains a die adapted to form the semi-conductive composition in the shape desired. Although described herein as separate processes, the invention includes simultaneously forming the olefinic semi-conductive composition about the spaced-apart electrical conductors and forming and bonding the elastomeric polyurethane thereto according to steps (a)–(i) described above.

In FIG. 1, the elastomeric polyurethane is rendered into a melt-flowable state by extruder 2. Extruder 2 is any extruder having a screw, power, L/D ratio and heating and cooling functions suitable to extrude the olefinic semi-conductive composition in a uniform manner as is well known to those ordinarily skilled in the art of extrusion. A thermoplastic extruder having an L/D ration of about 24:1 has been found to be particularly suitable for extruding elastomeric polyurethanes.

Figure 4:
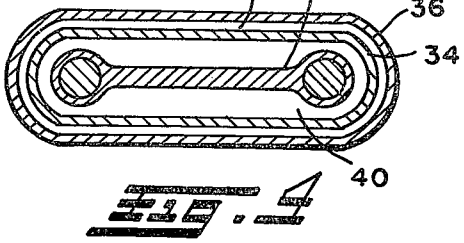
FIG. 4 shows a partial side elevation view of the exit side of die head 4 of FIGS. 1 and 2.
Figure 2:
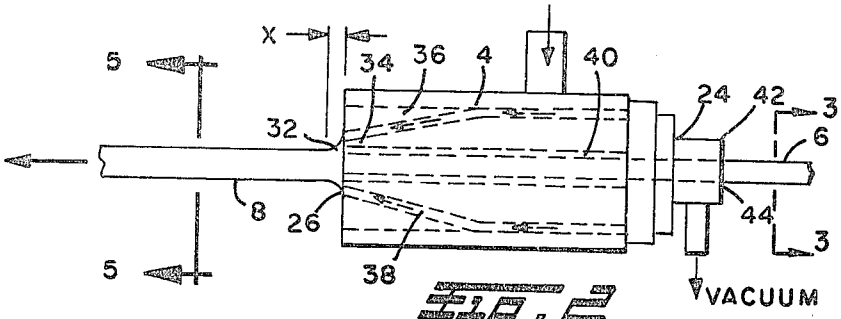
FIG. 2 shows a plan view of die head 4 shown in FIG. 1.

Die head 4, as hereinafter more fully described with respect to FIGS. 2 and 4, is in fluid communicating attachment with Extruder 2 and contains a die that is adapted to receive the melt extruded polymeric polyurethane from extruder 2 and form it into a shaped annular layer about product 6 passing through die head 4 in the direction of the arrows comprising the semi-conductive composition formed about the spaced-apart electrical conductors. Product 6 is preferably fed from a pay-off stand 10 into a tension device 12 that is adapted to maintain tension on product 6 as it passes through die head 4 as is well known to those skilled in the art of extrusion. Product 6 preferably passes through a straightening device such as opposed tensioned rollers before it passes through oxidizer 14 and into die head 4.

It has been discovered that an essential step in making the self-regulating heating cable of the invention is to oxidize the outer surface of the olefinic semi-conductive composition of product 6 before it enters into die head 4. A preferred method of oxidizing is provided by contacting the outer surface of the olefinic semi-conductive composition of product 6 with an open flame prior to its entrance into die head 4.

Product 6 is surrounded by a shaped annular layer of elastomeric polyurethane within die head 4 and exits in the direction of the arrow of product 8 which is then cooled by suitable means such as by water bath 16 before it is either cut into desired lengths or coiled upon reels by means of an automatic coiler such as coiler 22. Product 8 may pass through an electrical testing device such as a high voltage chain type tester 18 to detect any flaws in the shape-retaining polymeric polyurethane jacket as is well known to those skilled in the art. Product 8 is pulled in the direction of the arrows towards coiler 22 by means of a suitable pulling divice 20 such as a caterpillar or the like as is well known in the art of extrusion.

Product 8 comprising the shape-retaining elastomeric polyurethane jacketed olefinic semi-conductive composition electrically interconnecting the spaced-apart electrical conductors) is next annealed as shown in FIG. 1 at a temperature at or near the crystalline melting point(s) of the olefinic semi-conductive composition for a period of time suitable to provide the olefinic semi-conductive composition with the ambient electrical resistance desired as is well known to those skilled in the art. Product 8 may be annealed by a batch method or continuously in combination with the extrusion operation shown in FIG. 1 which may also be done simultaneously with the forming of the olefinic semi-conductive composition about the spaced-apart electrical conductors as previously described.

As shown in FIGS. 1, product 8 is next exposed to an amount of radiation sufficient to crosslink the olefinic semi-conductive composition to the degree necessary to provide the self-regulating characteristics desired as is well known to those ordinarily skilled in the art of making semi-conductive self-regulation heating cables. Preferably, the radiation is in the form of high energy electrons such as provided by a suitable electron beam generator. Depending upon the particular olefinic semi-conductive composition used, from about 5 to about 35 megrads of electron radiation have been found suitable to provide the self-regulating characteristics desired. Product 8 may be exposed to radiation in a continuous operation in conjunction with the annealing and extrusion steps previously described but is preferably exposed to radiation as a separate operation.

It has been surprisingly discovered that, although melt fusion of an elastomeric polyurethane to an olefinic semi-conductive composition has in the past resulted in poor bonding, bonding levels can be greatly improved by what is believed to be radiation grafting arising primarily by first oxidizing the surface of the olefinic semi-conductive composition and then drawing the polyurethane intimately thereagainst under conditions more fully described with respect to FIG. 2 before annealing and exposing the product to radiation.

Figure 3:
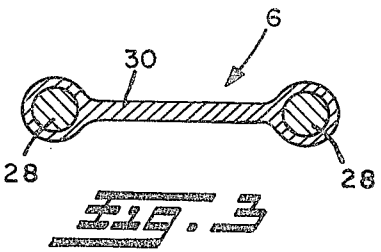
FIG. 3 shows a cross-sectional view 3—3 of self-regulating heating cable 6 passing into the die head 4 of FIGS. 1 and 2.
Figure 5:
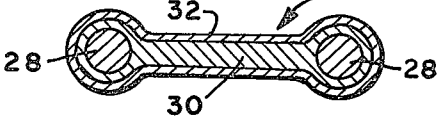
FIG. 5 shows a cross-sectional view 5—5 taken through self-regulating heating cable 8 after exiting from die head 4 of FIGS. 1, 2 and 4.

FIG. 2 shows a front view of die head 4 of FIG. 1. Die head 4 has an entrance 24 for receiving previously described product 6 which is shown in cross-section in FIG. 3. As shown in FIG. 3, product 6 has a substantially dumbbell-shaped cross-section comprising a pair of spaced-apart electrical conductors 28 electrically interconnected by olefinic semi-conductive composition 30. Product 6 moves through die head 4 and then passes from die head 4 at exit 26 in the form of product 8 shown in cross-section 5—5 in FIG. 5 comprising product 6 enclosed by layer 32 of elastomeric polyurethane which is subsequently cooled, annealed and exposed to radiation as previously described.

Die head 4 of FIGS. 1 and 2 is adapted to enable the elastomeric polyurethane exiting extruder 2 to be formed into a shaped annular layer within die head 4 about product 6 as product 6 leaves exit 26 as better illustrated in the view of exit 26 shown in FIG. 4.

In FIG. 4, product 6 passes through passageway 40 extending through die head 4 within an enclosing nose 34 as is well known to those skilled in the art of extrusion die design. Nose 34 is surrounded by shaped annular space 38 which separates nose 34 an encompassing die 36 supported within die head 4. Nose 34 and die 36 are adjustably movable with respect to each other so as to enable adjustments to the width of space 38 about product 6. The elastomeric urethane enters die head 4 and passes around nose 34 within space 38 between die 36 and nose 34 and towards exit 26 in the general direction of the arrows shown in FIG. 2.

The elastomeric polyurethane exits die head 4 through space 38 in a shaped cross-sectional configuration that is determined by the cross-sectional shape of space 38. It has been discovered that a space 38 having a substantially oval configuration is particularly suitable for jacketing a product 6 having a substantially dumbbell shaped cross-section as shown in FIG. 4 in which the longest axis of the oval is substantially parallel to a plane taken parallel to the web of olefinic semi-conductive composition between the conductors.

As shown in FIG. 2, die head 4 is provided with means for applying a vacuum to space 38 by housing 42 which is attached to entrance side 24 of die head 4 and surrounds product 6 as it enters die head 4. Housing 42 has a cavity therethrough that provides suitable clearance to enable product 6 to pass therethrough and is connected to a suitable vacuum source as is well known to those skilled in the art of extrusion. Housing 6 is preferably provided with a suitable seal 44 as shown in FIG. 2 to enable a suitable vacuum to be drawn upon passageway 40. As shown in FIG. 2, elastomeric polyurethane layer 32 is drawn snugly against the outer surface of the formed olefinic semi-conductive composition of product 6 within a distance "x" from exit 26 of die head 4. It has been discovered that in order to achieve radiation grafting between elastomeric polyurethane layer 32 and the olefinic semi-conductive composition that layer 32 must have a cross-sectional configuration that in conjunction with sufficient vacuum is able to draw layer 32 snugly against the semi-conductive composition within a distance "x" from exit 26 that is not more than about one and one-half inch.

The effectiveness of the creation of a radiation grafted bond between a polyolefinic semi-conductive composition and a elastomeric polyurethane shape-retaining jacket by the hereinbefore described method is illustrated in following Table II.

TABLE II

| Product Type | Bond level (lbs.) After Extrusion | After Annealing | After Irradiation |
|---|---|---|---|
| A | .40 | .40 | Could Not Remove |
| A | .35 | .40 | Could Not Remove |
| A | .33 | .40 | Could Not Remove |
| B | .38 | .25 | 4.0 |
| B | .40 | .30 | 3.8 |
| B | .35 | .30 | 4.5 |

In above Table II, Products A and B comprise a self-regulating heating cable having a substantially dumbbell-shaped cross-section for which the shape retaining jacket is made from a polyether based elastomeric polyurethane having about a Shore D 49 hardness and the olefinic semi-conductive composition comprises a blend of about 80% by weight of a polyethylene having a density of about 0.918 gm/cm and about 20% by weight of an ethylene-ethyl acetate having an acetate content of about 18% into which is uniformly dispersed about 17% to about 20% of VULCAN XC-72 carbon black previously described. In product A, the polyurethane shape retaining jacket has a thickness of about 0.010 inch along the web between the conductors and about 0.020 inch around the outer circumference of the conductors. In product B, the thickness of the shape retaining jacket along the web between the conductors is about 0.015 inch and about 0.022 inch around the outer circumference of the conductors. For both products A and B, the cross-sectional configuration of the elastomeric polyurethane and a substantially oval shaped wall was drawn tightly about the olefinic semi-conductive composition within about one inch from the die exit.

Products A and B of above Table I, which were exposed to about 35 megarads of high energy electrons, clearly illustrate that a substantial bond is not achieved by melt fusion but rather by what is believed to be radiation grafting produced by the hereinbefore described method.

It is to be understood that self-regulating heating cables made in accordance with the invention may be annealed after the irradiation step such as shown in dashed lines in FIG. 1 and as for example disclosed U.S. Pat. No. 4,200,973 assigned to the assignee of the present invention, the disclosure of which is included herein by reference. It is also to be understood that the shape retaining elastomeric polyurethane jacket hereinbefore described is to be made of a thermoplastic polyurethane having sufficient strength at the annealing temperature to maintain the shape of the olefinic semi-conductive composition and prevent drifting of the electrical conductor. It is to be further understood that self-regulating heating cables made in accordance with the invention may include additional polymeric and/or metallic jackets disposed about the elastomeric polyurethane shape retaining jacket where such are desired for particular applications.

What is claimed is:

1. An improved, flexible, self-regulating heating cable of the type having at least one pair of elongate electrical conductors spaced-apart from each other coextensively along the length of the cable and electrically interconnected by means of a crosslinked olefinic semi-conductive composition containing from about 5 parts to about 25 parts by weight to the total weight of the semi-conductive composition of electrically conductive particles uniformly dispersed therein and having sufficient crystallinity to provide the self-regulating characteristics desired with both said conductors and said olefinic composition surrounded by an elastomeric polyurethane shape retaining jacket, wherein the improvement is characterized by said cable having improved mechanical and electrical integrity and handling characteristics as a result of said jacket and said olefinic semi-conductive composition being radiation grafted together by a process which includes the steps of:

(a) forming the olefinic semi-conductive composition about the conductors along the length thereof to provide the electrical interconnection therebetween;

(b) oxidizing the outer surface of the semi-conductive composition provided by step (a);

(c) passing the product provided by step (b) through a die head having an entrance and an exit;

(d) rendering the elastomeric polyurethane into a melt flowable state;

(e) introducing the polyurethane of step (d) into the die head of step (c);

(f) forming the polyurethane of step (d) within the die head of step (c) into a shaped annular layer about the product of step (b) by means of a die supported therewithin;

(g) introducing a vacuum between the product of step (b) and the shaped annular polyurethane layer of step (f) sufficient to draw said layer snugly thereagainst within not more than about one and one-half inches from the die exit;

(h) annealing the product of step (g) at a temperature and for a period of time sufficient to provide the semi-conductive composition with the ambient electrical resistance desired; and (i) exposing the product of step (g) to an amount of radiation sufficient to crosslink the semi-conductive composition to the degree desired and effect a radiation grafted bond of the elastomeric polyurethane layer thereto sufficient to enable said product to act as a unitary structure to improve the mechanical and electrical integrity and the handling characteristics of the cable.

2. The cable of claim 1 wherein the outer surface of the semi-conductive composition is oxidized in step (b) by contacting said surface with a flame.

3. The cable of claim 1 wherein the semi-conductive composition of step (a) is formed so as to encircle each of the conductors with a web of said composition extending therebetween to provide the semi-conductive composition with a substantially dumbbell shaped cross-section.

4. The cable of claim 3 wherein the elastomeric polyurethane is shaped within the die head in step (c) to provide a substantially oval shaped cross-section having its longest axis substantially parallel to a plane taken parallel to the web of the semi-conductive composition.

5. The cable of claim 1 wherein the elastomeric polyurethane is rendered into a melt flowable state in step (d) by extruding the polyurethane through a heated extruder.

6. The cable of claim 5 including annealing the product of step (i) at a temperature and for a period of time sufficient to provide the semi-conductive composition with the ambient electrical resistance desired.

7. A method for making a self-regulating heating having improved mechanical and electrical integrity and handling characteristics, said cable of the type having at least one pair of elongate electrical conductors spaced-apart from each other coextensively along the length of the cable that are electrically interconnected by means of a crosslinked olefinic semi-conductive composition with both said composition and said conductors encompassed by an elastomeric polyurethane shape retaining jacket, said composition containing from about 5 parts to about 25 parts by weight to the total weight of the semi-conductive composition of electrically conductive particles uniformly dispersed therein and having sufficient crystallinity to provide the self-regulating characteristics desired, and said method including the steps of:

(a) forming the olefinic semi-conductive composition about the conductors along the length thereof to provide the electrical interconnection therebetween;

(b) oxidizing the outer surface of the semi-conductive composition provided by step (a);

(c) passing the product provided by step (b) through a die head having an entrance and an exit;

(d) rendering the elastomeric polyurethane into a melt flowable state;

(e) introducing the polyurethane of step (d) into the die head of step (c);

(f) forming the polyurethane of step (d) within the die head of step (c) into a shaped annular layer about the product of step (b) by means of a die supported therewithin;

(g) introducing a vacuum between the product of step (b) and the shaped annular polyurethane layer of step (f) sufficient to draw said layer snugly thereagainst within not more than about one and one-half inches from the die exit;

(h) annealing the product of step (g) at a temperature and for a period of time sufficient to provide the semi-conductive composition with the ambient electrical resistance desired; and (i) exposing the product of step (g) to an amount of radiation sufficient to crosslink the semi-conductive composition to the degree desired and effect a radiation grafted bond of the elastomeric polyurethane layer thereto sufficient to enable said product to act as a unitary structure to improve the mechanical and electrical integrity and the handling characteristics of the cable.

8. The method of claim 7 wherein the outer surrace of the semi-conductive composition is oxidized in step (b) by contacting said surface with a flame.

9. The method of claim 7 wherein the semi-conductive composition of step (a) is formed so as to encircle each of the conductors with a web of said composition extending therebetween to provide the semi-conductive composition with a substantially dumbbell shaped cross-section.

10. The method of claim 9 wherein the elastomeric polyurethane is shaped within the die head in step (c) to provide a substantially oval shaped cross-section having its longest axis substantially parallel to a plane taken parallel to the web of the semi-conductive composition.

11. The method of claim 7 wherein the elastomer polyurethane is rendered into a melt flowable state in step (d) by extruding the polyurethane through a heated extruder.

12. The method of claim 7 including annealing the product of step (i) at a temperature and for a period of time sufficient to provide the semi-conductive composition with the ambient electrical resistance desired.

* * * * *